US008203912B2

(12) United States Patent
Roest et al.

(10) Patent No.: US 8,203,912 B2
(45) Date of Patent: Jun. 19, 2012

(54) CMUTS WITH A HIGH-K DIELECTRIC

(75) Inventors: Aarnoud Laurens Roest, Geldrop (NL); Klaus Reimann, Eindhoven (NL); Mareike Klee, Straelen (DE); Jozef Thomas Martinus van Beek, Rosmalen (NL); John Douglas Fraser, Woodinville, WA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 232 days.

(21) Appl. No.: 12/671,108

(22) PCT Filed: Jul. 31, 2008

(86) PCT No.: PCT/IB2008/053082

§ 371 (c)(1),
(2), (4) Date: Jan. 28, 2010

(87) PCT Pub. No.: WO2009/016606

PCT Pub. Date: Feb. 5, 2009

(65) Prior Publication Data

US 2010/0202254 A1 Aug. 12, 2010

Related U.S. Application Data

(60) Provisional application No. 60/952,918, filed on Jul. 31, 2007.

(51) Int. Cl.
*H04R 19/00* (2006.01)
*H04R 17/00* (2006.01)

(52) U.S. Cl. ..... 367/181; 367/180

(58) Field of Classification Search ..... 367/180, 367/181

See application file for complete search history.

(56) References Cited

U.S. PATENT DOCUMENTS 6,037,639 A 3/2000 Ahmad (Continued)

FOREIGN PATENT DOCUMENTS

| | | | |
|---|---|---|---|
| EP | 0231596 | B1 | 8/1987 |
| EP | 1761104 | A1 | 3/2007 |
| WO | 2006127821 | A2 | 11/2006 |

OTHER PUBLICATIONS

Oralkan, O.; Bayram, B.; Yaralioglu, G.G.; Ergun, A.S.; Kupnik, M.; Yeh, D.T.; Wygant, I.O.; Khuri-Yakub, B.T.; , "Experimental characterization of collapse-mode CMUT operation," Ultrasonics, Ferroelectrics and Frequency Control, IEEE Transactions on , vol. 53, No. 8, pp. 1513-1523, Aug. 2006.*

(Continued)

*Primary Examiner* — Thomas Tarcza
*Assistant Examiner* — James Hulka
(74) *Attorney, Agent, or Firm* — W. Brinton Yorks, Jr.

(57) ABSTRACT

A capacitive ultrasound transducer includes a first electrode, a second electrode, and a third electrode, the third electrode including a central region disposed in collapsibly spaced relation with the first electrode, and a peripheral region disposed outward of the central region and disposed in collapsibly spaced relation with the second electrode. The transducer further includes a layer of a high dielectric constant material disposed between the third electrode and the first electrode, and between the third electrode and the second electrode. The transducer may be operable in a collapsed mode wherein the peripheral region of the third electrode oscillates relative to the second electrode, and the central region of the third electrode is fully collapsed with respect to the first electrode such that the dielectric layer is sandwiched therebetween. Piezoelectric actuation, such as d31 and d33 mode piezoelectric actuation, may further be included. A medical imaging system includes an array of such capacitive ultrasound transducers disposed on a common substrate.

22 Claims, 3 Drawing Sheets

U.S. PATENT DOCUMENTS

| | | | | |
|---|---|---|---|---|
| 6,632,178 | B1 * | 10/2003 | Fraser | 600/459 |
| 2002/0153809 | A1 * | 10/2002 | Chen et al. | 310/360 |
| 2003/0103412 | A1 * | 6/2003 | Ladabaum et al. | 367/162 |
| 2003/0154911 | A1 * | 8/2003 | Eissler | 117/81 |
| 2005/0014850 | A1 * | 1/2005 | Hu | 516/22 |
| 2005/0075572 | A1 | 4/2005 | Mills | |
| 2005/0146240 | A1 * | 7/2005 | Smith et al. | 310/309 |
| 2005/0200241 | A1 | 9/2005 | Degertekin | |
| 2005/0203397 | A1 | 9/2005 | Degertekin | |
| 2005/0266150 | A1 * | 12/2005 | Yong et al. | 427/58 |
| 2006/0279174 | A1 | 12/2006 | Oliver | |

OTHER PUBLICATIONS

Chao Wang; Zheyao Wang; Tian-Ling Ren; Yiping Zhu; Yi Yang; Xiaoming Wu; Haining Wang; Huajun Fang; Litian Liu; , "A Micromachined Piezoelectric Ultrasonic Transducer Operating in d33 Mode Using Square Interdigital Electrodes," Sensors Journal, IEEE , vol. 7, No. 7, pp. 967-976, Jul. 2007.*

Lukacs, M.; Jianlma Yin; Guofeng Pang; Garcia, R.C.; Cherin, E.; Williams, R.; Mehi, J.; Foster, F.S.; , "Performance and Characterization of New Micromachined High-Frequency Linear Arrays," Ultrasonics, Ferroelectrics and Frequency Control, IEEE Transactions on , vol. 53, No. 10, pp. 1719-1729, Oct. 2006.*

Firas Akasheh, Todd Myers, John D. Fraser, Susmita Bose, Amit Bandyopadhyay, "Development of piezoelectric micromachined ultrasonic transducers", Sensors and Actuators A: Physical, vol. 111, Issues 2-3, Mar. 15, 2004, pp. 275-287.*

Guldiken, Rasim O. et al "CMUTs with Dual-Electrode Structure for Improved Transmit and Receive Performance" IEEE Transactions on Ultrasonics, Ferroelectrics and Frequency Control, vol. 53, No. 2, Feb. 1, 2006, pp. 483-491.

* cited by examiner

CMUTS WITH A HIGH-K DIELECTRIC

The present disclosure is directed to systems and methods for generating medical diagnostic images and, more particularly, to ultrasonic transducers.

Ultrasound transducers are typically fabricated from piezoelectric materials configured to transmit acoustic waves as a voltage is put across respective electrodes of the transducer. Backscattered waves are detected as electric polarization in the material. However, piezoelectric transducers can exhibit disadvantages in air or fluid-coupled applications, at least in part due to an impedance mismatch between the piezoceramic and the air or fluid of interest.

Because they are less costly to produce, are generally smaller in size, may enable higher frequency imaging, and typically also achieve a higher integration level than current ceramic transducers, CMUTs or capacitive micro-machined ultrasound transducers are possible candidates for future generations of transducers. CMUTs can be operated in either uncollapsed or collapsed conditions or 'modes'. Recent research shows that operation of a CMUT in the collapsed mode can, in at least some instances, result in an improved transmission of power.

Referring now to FIGS. 1-3, a typical CMUT is shown in CMUT 100. The CMUT 100 includes a substrate 102 and a membrane 104 ordinarily (e.g., when inactive) disposed and/or suspended above the substrate 102, such that the membrane 104 is separated from the substrate 102 by a gap 106. The gap chamber might be empty (vacuum) or filled with gas. The membrane 104 is an 'active' portion of the CMUT 100, at least insofar as the membrane 104 is capable of being elastically deflected toward the substrate 102.

The CMUT 100 further includes a top electrode 108 and a bottom electrode 110. The top electrode 108 is affixed to and disposed atop the membrane 104. The bottom electrode 110 can be formed atop the substrate 102 (e.g., comprising a layer of conductive material deposited thereon), or can form part of the substrate.

The CMUT 100 is operable in at least two different modes, as shown and described below with reference to FIGS. 2 and 3.

Referring specifically to FIG. 2, in a non-collapsed mode of operation of the CMUT 100, a DC actuation voltage is applied across the top and bottom electrodes 108, 110 of a magnitude sufficiently large to deflect the membrane 104 downward toward the substrate 102 due to electrostatic attraction, but not so large as to eliminate the gap 106 separating the membrane 104 from the substrate 102. It should be noted that FIGS. 1-3 may not be to scale. A typical displacement of the membrane 104 may be less than 50% of the gap 106 before the membrane 104 will tend to become unstable and collapse to the substrate 102.

Upon an AC voltage being added to the DC voltage across the top and bottom electrodes 108, 110, an oscillatory motion (not specifically shown) is produced in the membrane 104, which, in turn, may cause an acoustic wave (not shown) to be transmitted from the CMUT 100. Upon the membrane 104 being subjected to an impinging ultrasonic pressure field (not shown), an oscillatory motion (not specifically shown) is similarly produced in the membrane 104 and the top electrode 108, such that the resultant relative motion between the top and bottom electrodes 108, 110 generates AC detection currents when a bias DC voltage has been applied thereacross.

Turning now to FIG. 3, during the collapsed mode of operation of the CMUT 100, the DC actuation voltage applied across the top and bottom electrodes 108, 110 is of a magnitude large enough to deflect the membrane 104 downward toward the substrate 102 and into physical contact with the bottom electrode 110. This effectively eliminates the gap 106 (FIG. 1) between the membrane 104 and the substrate 102 at the center portion of the membrane 104. The remaining part of the membrane 104 that is not touching the bottom electrode 110 can still be operated, and higher electrostatic forces can be applied at the same voltage due to the reduced gap. In order to avoid short circuit, the membrane 104 is composed of a dielectric material. Breakdown and trapping of fixed charge in the dielectric material are two important issues having an unfavorable impact on the performance of the CMUT 100 during operation thereof in the collapsed mode. For instance, fixed charge in the dielectric material of the membrane 104 can tend to result in a modification of the DC actuation voltage of the CMUT 100.

Despite efforts to date, a need remains for efficient and effective CMUT apparatus and methods of use thereof. These and other needs are satisfied by the disclosed apparatus, systems and methods, as will be apparent from the description which follows.

Aspects of the present disclosure include a capacitive ultrasound transducer comprising a first electrode; a second electrode; a third electrode, the third electrode including a central region disposed in collapsibly spaced relation with the first electrode, and a peripheral region disposed outward of the central region and disposed in collapsibly spaced relation with the second electrode; and a layer of a high dielectric constant material disposed between the third electrode and the first electrode and between the third electrode and the second electrode. In accordance with aspects of the present disclosure, the capacitive ultrasound transducer is operable in a collapsed mode wherein the peripheral region of the third electrode oscillates relative to the second electrode, and the central region of the third electrode is fully collapsed with respect to the first electrode such that the layer of a high dielectric constant material is sandwiched therebetween. Piezoelectric actuation, e.g., d31 and d33 piezoelectric actuation, may further be included. A medical imaging system is further provided including an array of such capacitive ultrasound transducers disposed on a current substrate.

A method of operating a capacitive ultrasound transducer in accordance with an aspect of the present disclosure includes providing a capacitive ultrasound transducer including a first electrode, a second electrode, a third electrode in collapsibly spaced relation with respect to each of the first and second electrodes, and a layer of a high dielectric constant material disposed between the third electrode and the first electrode, and between the third electrode and the second electrode; collapsing a central region of the third electrode with respect to the first electrode such that the layer of a high dielectric constant material is sandwiched therebetween; and oscillating, with respect to the second electrode, a peripheral region of the third electrode disposed outward of the central region.

To assist those of skill in the art in making and using the disclosed apparatus, systems and methods, reference is made to the accompanying figures, wherein.

Figure 1:
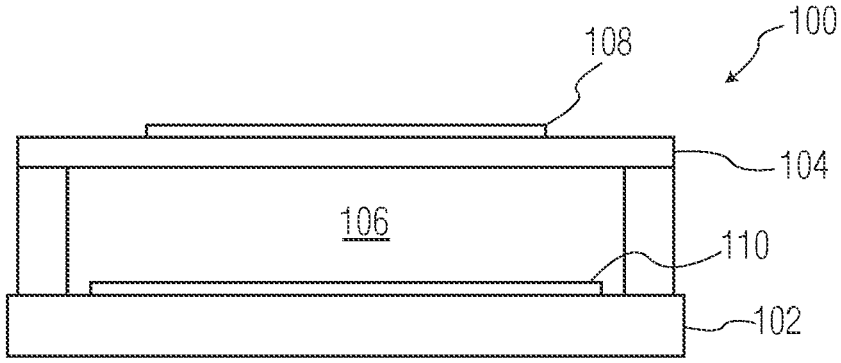
FIG. 1 PRIOR ART
FIG. 1 illustrates a prior art CMUT.
Figure 2:
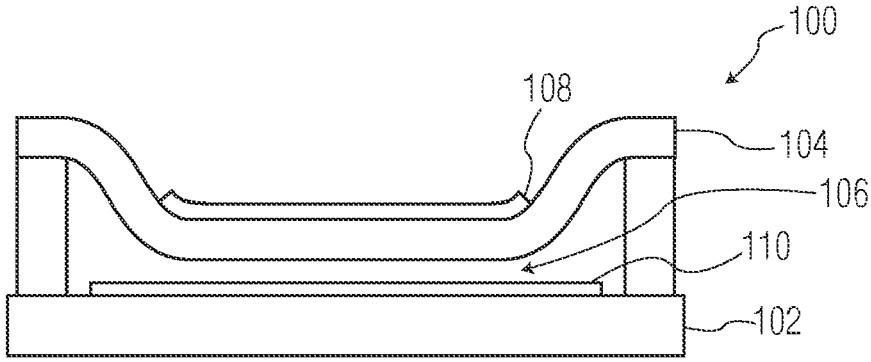
FIG. 2 PRIOR ART
FIG. 2 illustrates the CMUT of FIG. 1 in a non-collapsed mode of operation.
Figure 3:
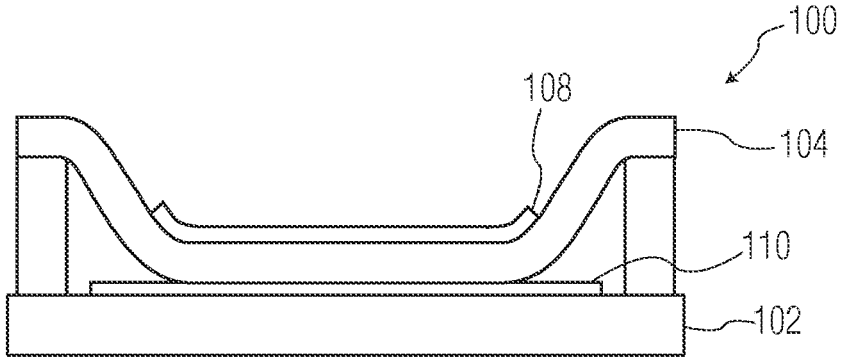
FIG. 3 PRIOR ART
FIG. 3 illustrates the CMUT of FIG. 1 in a collapsed mode of operation.
Figure 4:
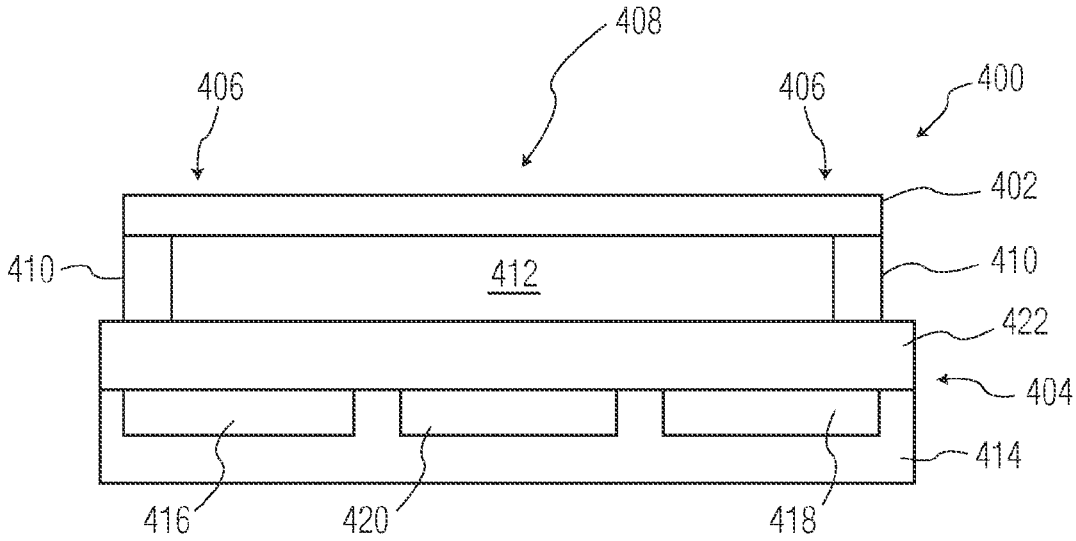
FIG. 4 illustrates a CMUT according to the present disclosure.

Referring now to FIG. 4, a CMUT 400 is shown in accordance with an exemplary aspect of the present disclosure. The CMUT 400 may include an electrode 402 and a wafer 404 above which the electrode 402 is suspended. The electrode 402 may include one or more peripheral regions 406 and a central region 408, wherein the central region 408 may be disposed adjacent to and/or between the peripheral regions 406. The electrode 402 may be deflectable (e.g., downwardly deflectable) relative to the wafer 404, and may be grounded from a side of the CMUT 400.

The CMUT 400 may further include one or more spacers 410 via which the electrode 402 may be assembled in spaced relation with the wafer 404. For example, the spacers 410 may be coupled to and extend upward from the wafer 404, and the electrode 402 may be affixed to the spacers 410 via the peripheral regions 406 of the electrode 402 being coupled thereto. In such circumstances, the CMUT 400 may, at least in a non-operating or non-actuated mode, exhibit or include a gap 412 between the electrode 402 and the wafer 404. In accordance with aspects of the present disclosure, the gap 412 may be created by forming a layer or layers of material (not shown) on the wafer 404. Such material or materials may include, for example, PMMA, silicon, a metal, or other suitable material. The electrode 402 may be formed atop such material or materials, after which such material or materials may be removed using, for example, an appropriate etching procedure, or a thermal decomposition step. In accordance with aspects of the present disclosure, the gap 412 may be created by producing the electrode 402 separately, and attaching the electrode 402 to the wafer 404 via the spacers 410 at a later time, using, for example, standard wafer bonding techniques. The gap 412 may be empty (vacuum) or may contain gas.

The CMUT 400 may include a top membrane (not separately shown) of which the electrode 402 forms a part. In some aspects, such a top membrane may include the electrode 402 plus additional dielectric layers (not shown) formed on the electrode 402. In some aspects, such a top membrane may include at least a thin dielectric layer (not shown) disposed below the electrode 402, and provided as protection during sacrificial layer removal.

The wafer 404 may include a substrate 414. The substrate 414 may be any substrate of suitable size, structure and composition to support and/or permit the fabrication, inclusion or assembly of other elements of the CMUT 400. The substrate 414 may further include drive electronics and/or receive electronics (not shown). The wafer 404 may further include a first electrode 416, a second electrode 418, and a third electrode 420. As shown in FIG. 4, the first, second, and third electrodes 416, 418, 420 may be arranged in laterally spaced relation within a common plane of the wafer 404, such that the third electrode 420 is disposed between and/or 'flanked' by the first and second electrodes 416, 418, the significance of which arrangement will be discussed in greater detail below. The first, second, and third electrodes 416, 418, 420 may be fabricated utilizing standard lithographic steps, and may comprise conductive materials that are compatible with high dielectric constant (high-k) processing, the significance of which feature will be discussed in greater detail below. For instance, in accordance with aspects of the present disclosure, the first, second, and third electrodes 416, 418, 420 may be made of platinum (Pt), processed on top of the substrate 414 with or without a barrier layer (such as Ti), and then lithographically patterned. Other materials for such electrodes are possible. For example, the electrodes may include highly conductive Si regions implanted into the substrate 414.

The first and second electrodes 416, 418 may be electrically commoned. In aspects of the present disclosure, the first and second electrodes 416, 418 may be disposed opposite one another and/or outward (e.g., radially outward) of the third electrode 420 (e.g., on opposite sides thereof), and/or may form part of the same electrode (e.g., forming a ring or other closed shape). The lateral geometries of the first and second electrodes 416, 418 may be optimized, e.g., for best area coverage and easiest manufacturing, and may include a variety of shapes, including linear/elongate, circular, polynomial, and/or rectangular. Other electrode configurations are possible, including configurations in which the first and second electrodes 416, 418 are electrically separate.

The electrode 402 may constitute an entire membrane, as shown in FIG. 4. Alternatively, and as discussed further below, the electrode 402 may constitute part of a multi-component membrane that may be patterned to cover the first, second, and third electrodes 416, 418, 420.

The wafer 404 may further include a dielectric layer 422 composed of a high-k dielectric material and disposed atop the first, second, and third electrodes 416, 418, 420. The high-k dielectric material of the dielectric layer 422 may be deposited using any suitable and/or conventional process, such as the well-known sol-gel process, followed by a Rapid Thermal Annealing (RTA) treatment to provide a suitable degree of structural density. Other processes for the formation of the dielectric layer 422, such as sputtering or chemical vapor deposition (CVD), are possible. The high-k dielectric material may further be any suitable such material, including but not limited to Barium Strontium Titanate (BST) and/or lead Zircon Titanates (PZT). Such high-k layers may be deposited doped or undoped. Other high-k dielectric materials are possible. Barrier and/or adhesion layers (not shown) such as $Al_2O_3$, TiN, $TiO_2$, $ZrO_2$, $SiO_2$, $Si_3N_4$, and/or Ir02 may also be employed below or above the dielectric layer 422 and/or the first, second, and third electrodes 416, 418, 420. Such barrier and/or adhesion layers may, for example, be removed or thinned from the top of the dielectric layer 422 after sacrificial layer etching, or patterned together with the high-k layer or the electrodes 416, 418, 420 to limit parasitic electrical effects.

Wherein current dielectrics used in CMUTs are typically silicon oxides or silicon nitrides, replacing such materials in accordance with the present disclosure with a material of a much higher dielectric constant such as BST may have the effect of concentrating the electric field in the gap 412. In this way, the CMUT 400 may be associated with lower impedance and/or operating voltages, and may facilitate the use of standard driving electronics. There are additional, outstanding advantages for the collapsed mode, described more fully below. The electric field inside the dielectric layer 422 may be smaller than the field in the gap 412 by a factor equivalent to the associated dielectric constant K, so that charge trapping can be lowered. The high-k materials of the CMUT 400 may be selected and/or formed such that dielectric absorption and charge trapping affect their performance only marginally. This performance characteristic may, for example, be due to a large internal polarization that compensates charges easily. In accordance with some aspects of the present disclosure, such materials may further be doped, either for preventing charge from accumulating inside and on the surface of the dielectric layer 422, or for intentionally allowing some leakage current to prevent charge storing from occurring at all. In accordance with some aspects of the present disclosure, the integration of piezoelectric high-k materials, such as Lead Zirconate Titanate (PZT), may allow a combined capacitive (CMUT) and piezoelectric (PMUT) operation. As described further below, an electrode may be provided for CMUTs in accordance with the present disclosure that enhances the effective electromechanical coupling coefficient of a CMUT device. In accordance with aspects of the present disclosure, such enhancement of the electromechanical coupling coefficient may be accomplished independent of the particular dielectric layer used.

Figure 5:
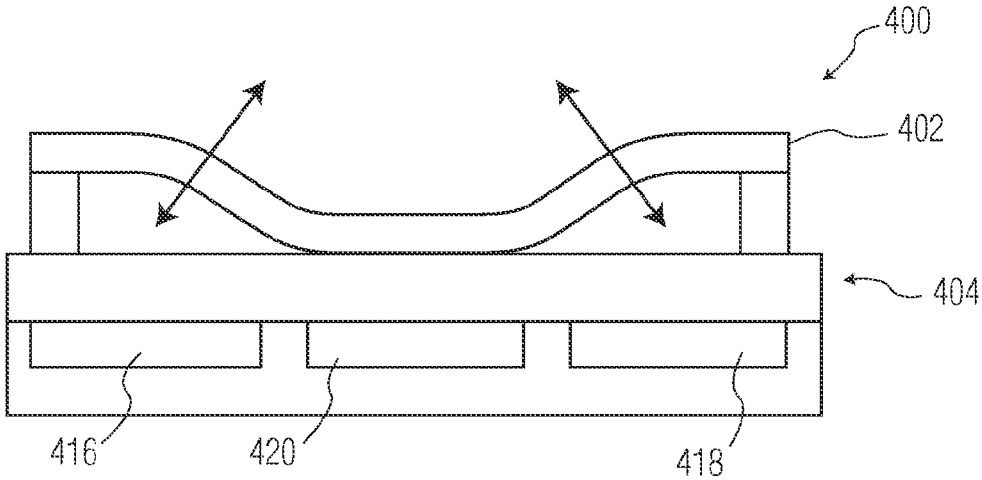
FIG. 5 illustrates the CMUT of FIG. 4 in a collapsed mode of operation in accordance with the present disclosure.

Referring now to FIG. 5, in operation, a DC voltage may be applied across the electrode 402 of the CMUT 400 and the third electrode 420 of the wafer 404, such that the electrode 402 is deflected downward into contact with the wafer 404, permitting the CMUT 400 to be operated in the collapsed mode. In accordance with aspects of the present disclosure, an AC signal may be applied to the first and second electrodes 416, 418 only. Separating the electrodes may increase the coupling coefficient by isolating the parasitic capacitance of the collapsed part. In accordance with aspects of the present disclosure, the first and second electrodes 416, 418 may carry a higher bias voltage than the centrally-disposed third electrode 420 for optimizing the coupling coefficient.

The DC voltage on the third electrode 420 may be adjusted for optimum results, and/or may be utilized as a feedback and control electrode to set an optimal operation point (e.g., with respect to a degree of deflection of the electrode 402). In accordance with aspects of the present disclosure, the shape of the electrode 402 may be any suitable shape, including but not limited to rectangular, hexagonal, and/or circular, such that any restrictions imposed by the electrode configuration are generally minimal.

Figure 6:
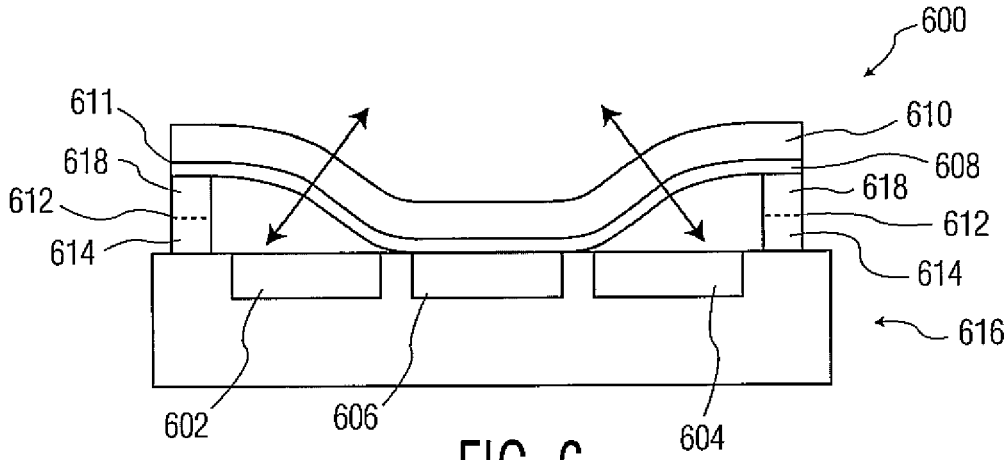
FIG. 6 illustrates another CMUT in accordance with the present disclosure.

Referring now to FIG. 6, a modified version of the CMUT 400 may be provided in the form of a CMUT 600 in accordance with aspects of the present disclosure. The CMUT 600 may be structurally and/or functionally similar to the CMUT 400 in most or all important respects, including, for example, exhibiting respective first and second electrodes 602, 604 flanking a centrally disposed third electrode 606, a layer 608 of high-k dielectric material, and an electrode 610, wherein the layer 608 is disposed between the first, second, and third electrodes 602, 604, 606 and the electrode 610. The CMUT 600 may further include at least some differences with respect to the CMUT 400; including, for example, such differences as are discussed immediately below.

The CMUT 600 may include a membrane 611, wherein the membrane 611 may include both the electrode 610 and the layer 608 of high-k dielectric material. More particularly, the layer 608 may be deposited on the electrode 610 as part of a process of forming the membrane 611. The high-k dielectric material of which the layer 608 is made may be, for example, BST or PZT. Providing the CMUT 600 with a high-k dielectric layer in such a manner (e.g., depositing the layer 608 on the electrode 610 to form the membrane 611) may ease manufacturing in the case of certain bonding processes. For example, the layer 608 may be processed on a separate carrier together with the electrode 610 (and/or together with other layers of a still larger membrane (not shown) of which the electrode 610 may form a part) and then bonded to the spacers 612.

In accordance with aspects of the present disclosure, the spacers 612 may be formed from multiple parts. For instance, and as shown in FIG. 6, a first part 614 of the spacer 612 may be formed on a wafer 616, and a second part 618 of the spacer 612 may be formed on or with the membrane 611 (e.g., on the electrode 610 and/or on the dielectric layer 608). In such circumstances, the respective materials of the first and second parts 614, 618 of the spacer 612 may be selected with a view toward providing an optimal combination for bonding purposes. For example, at least the second part 618 of the spacer 612 may be made from electrically conductive material, e.g., so as to form an appropriate contact for establishing an electrical connection with the electrode 610. To facilitate such electrical contact, the dielectric layer 608 may, for example, be patterned as necessary to form respective vias.

The wafer 616 may comprise a CMOS wafer that includes electronics (not shown) in addition to the first, second, and third electrodes 602, 604, 606. In aspects of the present disclosure in which the wafer 616 of the CMUT 600 is a CMOS wafer, the above-described arrangement of electrical contact with respect to the electrode 610 may be particularly advantageous.

As is well known to those of skill in the pertinent art, many high-k materials, especially those of perovskite and related structures, also exhibit piezoelectric properties. In accordance with aspects of the present disclosure, and for example, such piezoelectric properties may be exploited for additional movement or adjustment of the electrode 610 when, as in CMUT 600, the dielectric layer 608 is combined with the electrode 610 to form a larger membrane 611. Respective aspects of the present disclosure shown and discussed below with reference to FIGS. 7 and 8 exemplify such an arrangement.

Figure 7:
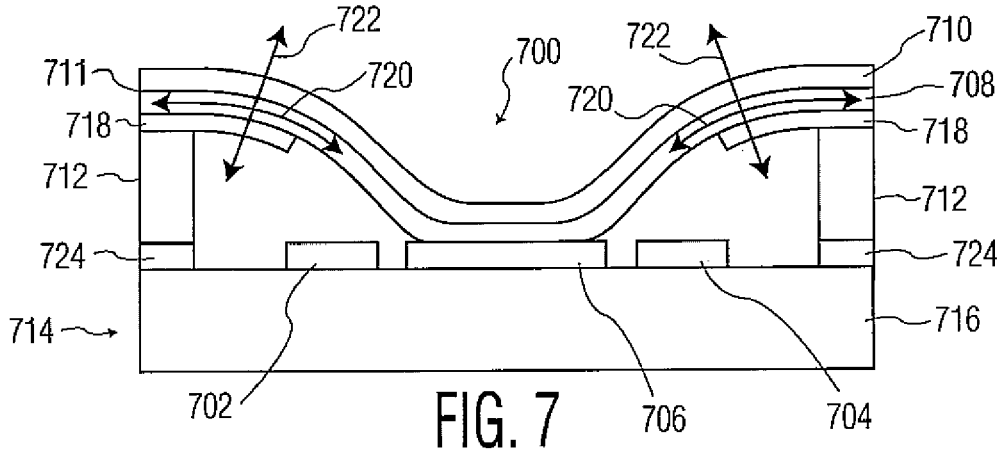
FIG. 7 illustrates yet another CMUT in accordance with the present disclosure.

Referring now to FIG. 7, a modified version of the CMUT 600 of FIG. 6 may be provided in the form of a CMUT 700 in accordance with aspects of the present disclosure. The CMUT 700 may be structurally and/or functionally similar to the CMUT 600 in most or all important respects, including, for example, exhibiting respective first and second electrodes 702, 704 flanking a centrally-disposed third electrode 706, a layer 708 of high-k dielectric material, an electrode 710 (wherein the layer 708 is deposited on the electrode 710 to provide a membrane 711 and is disposed between the first, second, and third electrodes 702, 704, 706 and the electrode 710), and spacers 712 upon which the membrane 711 is collapsibly mounted relative to a wafer 714. The CMUT 700 may further include at least some differences with respect to the CMUT 600; including, for example, such differences as are discussed immediately below.

The wafer 714 of the CMUT 700 may include a substrate 716, and the first, second, and third electrodes 702, 704, 706 may be deposited on the substrate 716. The CMUT 700 may further include one or more additional electrodes 718, each of which additional electrode 718 may be disposed on a respective one of the spacers 712. The dielectric layer 708 may, in turn, be disposed between the electrode 710 and the electrode 718. In such circumstances, the electrode 718 may facilitate piezoelectric actuation in accordance with the so-called "d31" mode of piezoelectric operation. More particularly, a predominant actuation strain in the CMUT 700 in collapsed mode operation may occur along a direction 720, while at the same time, in accordance with the d31 mode, the CMUT 700 may employ an electrical field aligned along a polarization axis 722 that is oriented substantially perpendicularly with respect to the direction 720.

In some aspects, the electrodes 710 and 718 may be metal layers, e.g., formed from Pt, Au, Ti, Cr, Ni, Al and/or Cu. In some aspects, the electrodes 702, 704, 706, 710, 718 may be formed from Pt, Au, Ti, Cr, Ni, Al, Cu, Sn, or Si, or a combination of two or more such materials. Other materials, e.g., the conductive oxides and nitrides YBCO, TiN, SRO, are possible.

In accordance with aspects of the present disclosure, the electrode 718 may include a geometry that is abbreviated with respect to a broader lateral extent of the membrane 711. Such an arrangement may prevent the electrode 718 from overlapping any or all of the first, second, or third electrodes 702, 704, 706, and thereby reduce and/or eliminate the risk of a short circuit. Such an arrangement may further facilitate critical process and driving control. In other aspects, at least some overlap exists.

The wafer 714 of the CMUT 700 may include one or more additional electrodes 724 formed on the substrate 716, which additional electrodes 724 may be formed with the first, second, and third electrodes 702, 704, 706 as part of the same electrode layer of the wafer 714, with electrical interruptions as necessary and/or as desired. In accordance with aspects of the present disclosure, the spacers 712 may be assembled to the wafer 714 at the electrodes 724 and may be made from appropriate electrically conductive materials such that the spacers 712 form part of an electrical path through the wafer 714 and the electrodes 724 via which an actuating voltage may be applied across the electrodes 710, 718. In at least some aspects of the present disclosure, the spacers 712 may be substantially non-conductive, and/or may be otherwise similar in structure and function to the spacers 612 of the CMUT 600.

Figure 8:
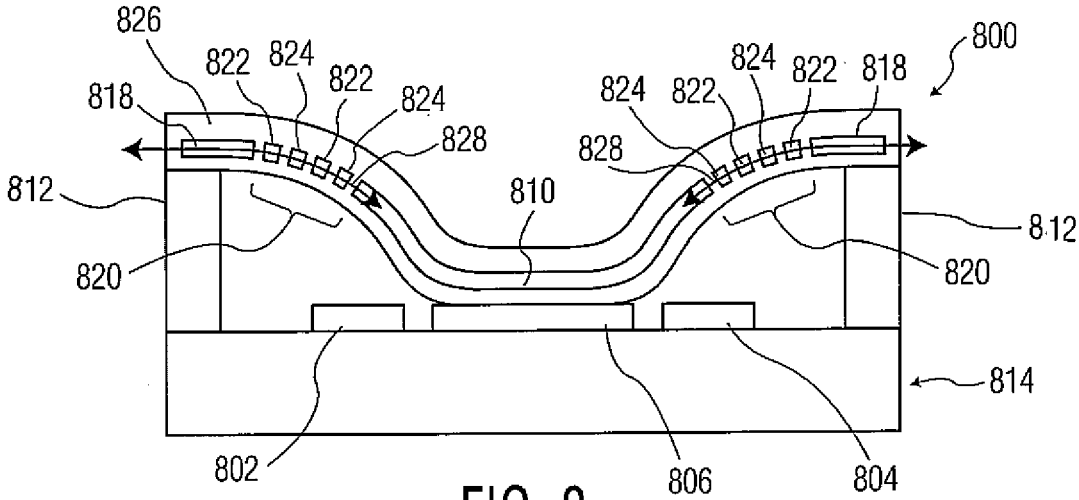
FIG. 8 illustrates still another CMUT in accordance with the present disclosure.

Referring now to FIG. 8, a modified version of the CMUT 600 of FIG. 6 may be provided in the form of a CMUT 800 in accordance with aspects of the present disclosure. The CMUT 800 may be structurally and/or functionally similar to the CMUT 600 in most or all important respects, including, for example, exhibiting respective first and second electrodes 802, 804 flanking a centrally-disposed third electrode 806, a layer 808 of high-k dielectric material, an electrode 810 (wherein the layer 808 is deposited on the electrode 810 as part if a membrane 811 and is disposed between the first, second, and third electrodes 802, 804, 806 and the electrode 810), and spacers 812 upon which the membrane 811 is collapsibly mounted relative to a wafer 814. The wafer 814 may further be structurally and/or functionally similar to the wafer 714 of the CMUT 700 in that the wafer 814 may include a substrate 816, and the first, second, and third electrodes 802, 804, 806 may be deposited on the substrate 816. The CMUT 800 may further include at least some differences with respect to the CMUT 600; including, for example, such differences as are discussed immediately below.

The membrane 811 of the CMUT 800 may include one or more interdigitating electrodes 818 within a plane containing the electrode 810. For example, and as shown in FIG. 8, the electrode 810 may be patterned to form respective piezoelectric actuation regions 820 wherein the electrode 810 exhibits a pattern of digits 822 that interdigitate with corresponding digits 824 of the respective electrodes 818. The membrane 811 may optionally include an additional membrane support 826 to improve ruggedness and to provide electrical isolation, e.g., between and among the interdigitating digits 822, 824, and between the electrode 810 and the medium in which the ultrasound waves are emitted and/or received. In such circumstances, the electrode 814 may facilitate piezoelectric actuation in accordance with the so-called "d33" mode of piezoelectric operation. More particularly, a predominant actuation strain in the CMUT 800 in collapsed mode operation may occur along a direction 828, while at the same time, in accordance with the d33 mode, the CMUT 800 may employ an electrical field having a polarization axis that is oriented in the same direction 828. The d33 mode, wherein the piezoelectric material is actuated along the same direction associated with the electrical field polarization axis, may have an advantage, at least insofar as no additional electrode layers need necessarily be deposited or formed with respect to the dielectric layer 808.

In accordance with aspects of the present disclosure, the spacers 812 may be made from appropriate electrically conductive materials such that the spacers 812 form part of an electrical path through the wafer 814 along which an actuating voltage may be applied across the electrodes 810, 818. In at least some aspects of the present disclosure, the spacers 812 may be substantially non-conductive, and/or may be otherwise similar in structure and function to the spacers 612 of the CMUT 600. The spacers 812 may be commoned electrically and be used to contact the electrodes 818 separately my means of via-holes etched in the dielectric layer 808.

The membrane 811 may be optional for all CMUT examples in accordance with the present disclosure, at least insofar as the electrode 810 is provided along with the additional membrane support 826. The membrane support 826 may be used to improve mechanical performance, to tailor acoustic impedance, and/or to improve manufacturing processes, e.g., by providing an etch-stop or barrier.

In accordance with aspects of the present disclosure, separate driving and receiving electronics (not separately shown) may be used, provided, for example, care is taken to keep parasitic capacitances low, e.g., by using flanking electrodes.

The disclosed apparatus, systems and methods are susceptible to many further variations and alternative applications, without departing from the spirit or scope of the present disclosure.

The invention claimed is:

1. A capacitive ultrasound transducer, comprising:

a first electrode;

a second electrode;

a membrane electrode, the third electrode including a central region disposed in fully collapsed relation without a gap with the first electrode, and a peripheral region disposed outward of the central region and disposed in a spaced relation across a gap from the second electrode; and a layer of a high dielectric constant material disposed between the membrane electrode and the first electrode and between the membrane electrode and the second electrode, wherein the peripheral region of the third electrode oscillates relative to the second electrode, and wherein the capacitive ultrasound transducer operates in a collapsed mode with the high dielectric constant material sandwiched between the membrane electrode and the first electrode.

2. A capacitive ultrasound transducer in accordance with claim 1, wherein the layer of a high dielectric constant material is disposed in collapsibly spaced relation with the second electrode.

3. A capacitive ultrasound transducer in accordance with claim 2, wherein the membrane electrode is disposed on a membrane layer; and wherein the layer of a high dielectric constant material and the membrane layer are affixed to each other.

4. A capacitive ultrasound transducer in accordance with claim 1, wherein the layer of a high dielectric constant material is affixed to the first and second electrodes such that the central region of the membrane electrode is further in fully collapsed relation with the layer of a high dielectric constant material and the peripheral region of the membrane electrode is in spaced apart relation with the layer of a high dielectric constant material.

5. A capacitive ultrasound transducer in accordance with claim 1, wherein the dielectric constant of the high dielectric constant material layer has a value of at least 100.

6. A capacitive ultrasound transducer in accordance with claim 1, further comprising a fourth electrode, wherein the first electrode is disposed between the second electrode and the fourth electrode, and the membrane electrode further includes another peripheral region disposed outward of the central region and disposed in collapsibly spaced relation with the fourth electrode, and wherein the layer of a high dielectric constant material is further disposed between the membrane electrode and the fourth electrode.

7. A capacitive ultrasound transducer in accordance with claim 1, wherein the second electrode further comprises fourth and fifth electrodes disposed on opposite sides of the first electrode.

8. A medical imaging system comprising a capacitive ultrasound transducer in accordance with claim 1.

9. A medical imaging system comprising an array of capacitive ultrasound transducers in accordance with claim 1 disposed on a common substrate.

10. A capacitive ultrasound transducer comprising:

a first electrode;

a second electrode;

a third electrode, the third electrode including a central region disposed in collapsibly spaced relation with the first electrode, and a peripheral region disposed outward of the central region and disposed in collapsibly spaced relation with the second electrode; and a layer of a high dielectric constant material disposed between the third electrode and the first electrode and between the third electrode and the second electrode, and further including a piezoelectric layer and a fourth electrode, and wherein the third and fourth electrodes are cooperative for applying an electric field to the piezoelectric layer.

11. A capacitive ultrasound transducer in accordance with claim 10, wherein each of the third and fourth electrodes is affixed to the layer of a high dielectric constant material.

12. A capacitive ultrasound transducer in accordance with claim 11, wherein the layer of a high dielectric constant material is sandwiched between the third and fourth electrodes and forms at least a portion of the piezoelectric layer.

13. A capacitive ultrasound transducer in accordance with claim 12, wherein the third and fourth electrodes are cooperative for producing d31 mode piezoelectric coupling with respect to the piezoelectric layer.

14. A capacitive ultrasound transducer in accordance with claim 11, wherein the third and fourth electrodes are disposed along a common side of the layer of a high dielectric constant material.

15. A capacitive ultrasound transducer in accordance with claim 14, wherein the third and fourth electrodes are interdigitated.

16. A capacitive ultrasound transducer in accordance with claim 14, wherein the third and fourth electrodes are cooperative for producing d33 mode piezoelectric coupling with respect to the piezoelectric layer.

17. A method of operating a capacitive ultrasound transducer, comprising:

providing a capacitive ultrasound transducer including a first electrode, a second electrode, a membrane electrode in collapsibly spaced relation with respect to each of the first and second electrodes, and a layer of a high dielectric constant material disposed between the membrane electrode and the first electrode, and between the membrane electrode and the second electrode;

fully collapsing a central region of the membrane electrode with respect to the first electrode such that the layer of a high dielectric constant material is sandwiched therebetween; and oscillating, with respect to the second electrode, a peripheral region of the membrane electrode disposed outward of the central region.

18. A method of operating a capacitive ultrasound transducer, comprising:

providing a capacitive ultrasound transducer including a first electrode, a second electrode, a third electrode in collapsibly spaced relation with respect to each of the first and second electrodes, and a layer of a high dielectric constant material disposed between the third electrode and the first electrode, and between the third electrode and the second electrode;

collapsing a central region of the third electrode with respect to the first electrode such that the layer of a high dielectric constant material is sandwiched therebetween; and oscillating, with respect to the second electrode, a peripheral region of the third electrode disposed outward of the central region, wherein the capacitive ultrasound transducer further comprises a piezoelectric layer and a fourth electrode, and the method further comprises cooperatively employing the third and fourth electrodes to produce piezoelectric coupling with respect to the piezoelectric layer.

19. A method of operating a capacitive ultrasound transducer in accordance with claim 18, further comprising utilizing the piezoelectric coupling to calibrate at least one selected from a group comprising a gap, a stiffness, and a performance of the capacitive ultrasound transducer.

20. A method of operating a capacitive ultrasound transducer in accordance with claim 18, further comprising utilizing the piezoelectric coupling to support a capacitive actuation of the capacitive ultrasound transducer.

21. A method of operating a capacitive ultrasound transducer in accordance with claim 18, wherein the piezoelectric coupling includes d33 mode piezoelectric coupling.

22. A method of operating a capacitive ultrasound transducer in accordance with claim 18, wherein the piezoelectric coupling includes d31 mode piezoelectric coupling.

* * * * *

UNITED STATES PATENT AND TRADEMARK OFFICE

CERTIFICATE OF CORRECTION

PATENT NO. : 8,203,912 B2
APPLICATION NO. : 12/671108
DATED : June 19, 2012
INVENTOR(S) : Aarnoud Roest et al.

It is certified that error appears in the above-identified patent and that said Letters Patent is hereby corrected as shown below:

In the Claims

Col. 8, line 32, Claim 1 should read as follows:

1. A capacitive ultrasound transducer, comprising:
a first electrode;
a second electrode;
a membrane electrode, the membrane electrode including a central region disposed in fully collapsed relation without a gap with the first electrode, and a peripheral region disposed outward of the central region and disposed in a spaced relation across a gap from the second electrode; and
a layer of a high dielectric constant material disposed between the membrane electrode and the first electrode and between the membrane electrode and the second electrode,
wherein the peripheral region of the third electrode oscillates relative to the second electrode, and
wherein the capacitive ultrasound transducer operates in a collapsed mode with the high dielectric constant material sandwiched between the membrane electrode and the first electrode.

Signed and Sealed this
Twenty-seventh Day of January, 2015

Michelle K. Lee

Michelle K. Lee
*Deputy Director of the United States Patent and Trademark Office*